US005149140A

United States Patent [19]

Mowry, Jr. et al.

[11] Patent Number: 5,149,140

[45] Date of Patent: Sep. 22, 1992

[54] SECURITY, INFORMATION DOCUMENT

[75] Inventors: William H. Mowry, Jr., Dayton; Robert L. Neitman, Kettering, both of Ohio

[73] Assignee: The Standard Register Company, Dayton, Ohio

[21] Appl. No.: 667,283

[22] Filed: Mar. 11, 1991

[51] Int. Cl.[5] ..... B42D 15/00

[52] U.S. Cl. ..... 283/93; 283/94; 283/902

[58] Field of Search ..... 283/93, 902, 94

[56] References Cited

U.S. PATENT DOCUMENTS

| | | | |
|---|---|---|---|
| 4,168,088 | 9/1979 | Somlyody | 283/902 X |
| 4,210,346 | 7/1980 | Mowry, Jr. et al. | 283/902 X |
| 4,227,719 | 10/1980 | McElligott et al. | 283/902 X |
| 4,227,720 | 10/1980 | Mowry, Jr. et al. | 283/902 X |
| 4,265,469 | 5/1981 | Mowry, Jr. et al. | 283/902 X |
| 4,310,180 | 1/1982 | Mowry, Jr. et al. | 283/902 X |
| 4,341,404 | 7/1982 | Mowry, Jr. et al. | 283/902 X |
| 4,351,547 | 9/1982 | Brooks, II | 283/902 X |
| 4,360,548 | 11/1982 | Skees et al. | 283/902 X |
| 4,420,175 | 12/1983 | Mowry, Jr. | 283/93 |
| 4,579,370 | 4/1986 | Corwin et al. | 283/72 |
| 4,662,651 | 5/1987 | Mowry, Jr. | 283/70 |

*Primary Examiner*—Paul A. Bell

*Attorney, Agent, or Firm*—Killworth, Gottman, Hagan & Schaeff

[57] ABSTRACT

A security, information document for providing information to a reader from an information source organization includes a document substrate having a first area in which a half-tone warning image is printed, indicating that a copy of the document is an unauthorized document. A half-tone background image is printed in a second area on the substrate, with the second area surrounding the first area. A camouflage image extends over the document substrate for confusing the eye of an observer such that the warning image is not readily observed. One of the half-tone warning image and the half-tone background image is printed with a half-tone screen of such a line spacing that it is not readily reproducible by a copier. The camouflage image may contain an identification of the source of the information.

10 Claims, 4 Drawing Sheets

SECURITY, INFORMATION DOCUMENT

BACKGROUND OF THE INVENTION

This invention relates to a technique for protecting information from unauthorized reproduction and, more particularly, to a security, information document having a hidden message which becomes visible when the document is reproduced, thereby indicating that the copy of the document is unauthorized.

The problem of unauthorized reproduction of information is widespread. Documents which contain information which is copyrighted, proprietary, or confidential are often reproduced without proper authorization. Attempts have been made to stop this unauthorized reproduction by adding identifying marks to the original documents. However, these attempts have been unsuccessful because the identifying marks are easily removed from the copies using a razor blade, correction fluid, erasure, or other means. The copies can then be distributed with no clear indication that they emanate from a particular source, that the copies are not authorized, or that the possessor may have no right to have the information.

Therefore, there is a need for a security, information document which provides protection from unauthorized reproduction of the document, and which provides an indication of the source of the document.

SUMMARY OF THE INVENTION

The present invention fills this need. The present invention provides a secure document that discloses information to a reader, and indicates that the information is the product of a particular information source organization. The document comprises a document substrate having a first area in which a half-tone warning image is printed, evidencing that a copy of the document is an unauthorized document. There is a second area on the substrate in which a half-tone background image is printed, with the second area surrounding the first area. Either the half-tone warning image or the half-tone background image is printed with a half-tone screen of such a line spacing and dot size that it is not readily reproducible by a typical office copier. As a consequence, the warning image becomes readily apparent on copies of the document that are made on such a copier. The half-tone warning image indicating that a copy of the document is an unauthorized document preferably defines the words "UNAUTHORIZED COPY."

A camouflage image extends over the document substrate for the purpose of confusing the eye of an observer such that the warning image is not readily observed. The camouflage image may be defined by portions of the first area in which selected half-tone dots are not printed, by portions of the second area in which half-tone screens are not printed, or by portions of both the first area and the second area in which half-tone screens are not printed. The camouflage image may delineate the information source organization.

The half-tone background image and said half-tone warning image are preferably printed in black ink on the document substrate. The information on the security, information document may be printed over the first and second areas on the substrate. The information printed over the substrate is preferably printed in an ink of substantially the same blackness as the half-tone warning image and the half-tone background image. An attempt to copy the document without copying the half-tone warning image or the half-tone background image by adjustment of copier settings will result in loss of the information.

Accordingly, it is an object of the present invention to provide a security, information document for providing information to a reader from an information source organization in which a hidden warning image is apparent on copies of the document made by means of a typical office copier; to provide such a security, information document in which a camouflage image extends over the document substrate for confusing the eye of an observer so that the warning image is not readily observed; and to provide such a security, information document in which the camouflage image identifies the information source organization.

Other objects and advantages of the invention will be apparent from the following description, the accompanying drawings and the appended claims.

DETAILED DESCRIPTION OF THE PREFERRED EMBODIMENTS

Figure 1:
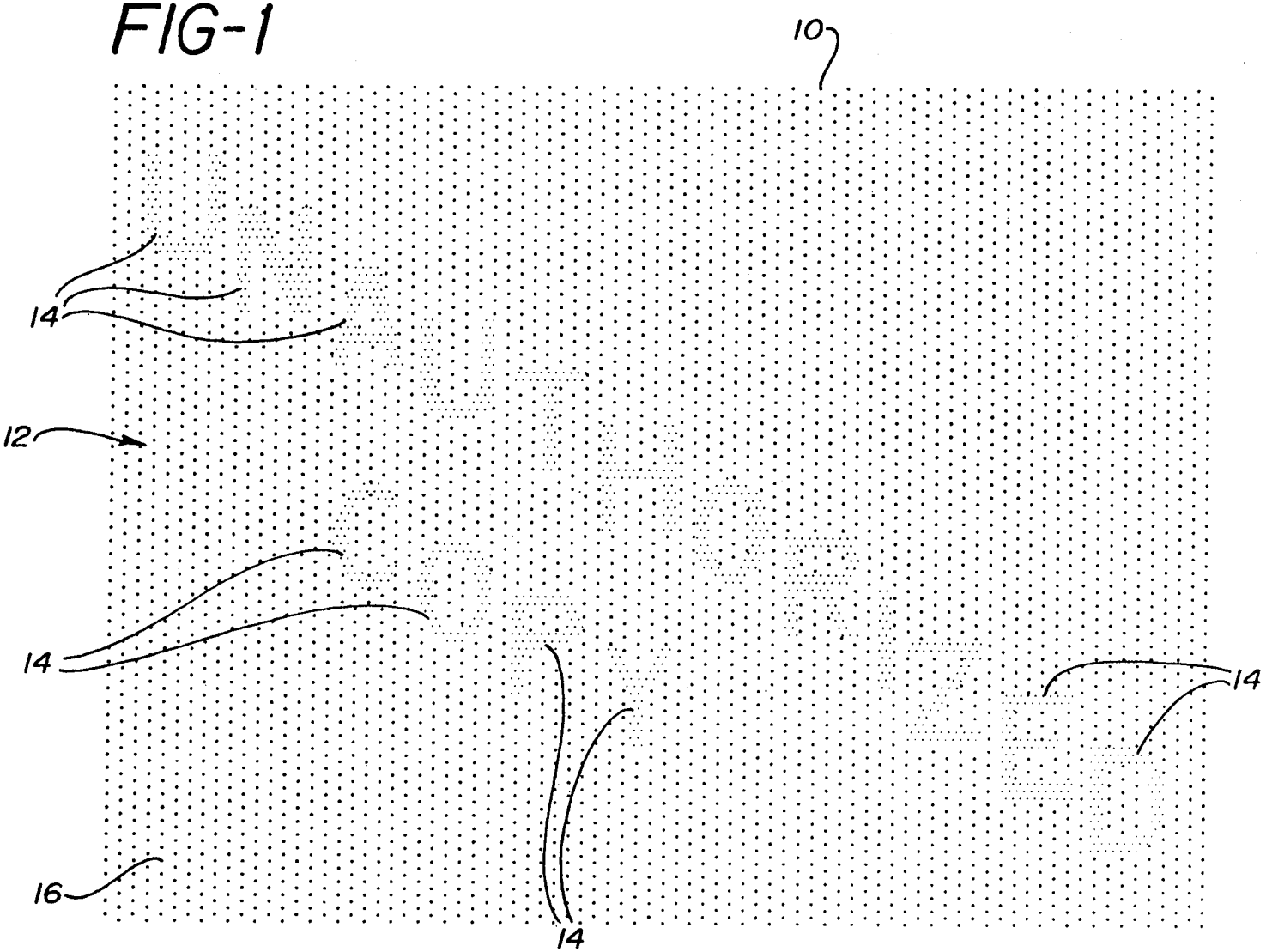
FIG. 1 is a schematic representation of a document including a hidden half-tone warning image indicating that a copy of the document is an unauthorized document.
Figure 2:
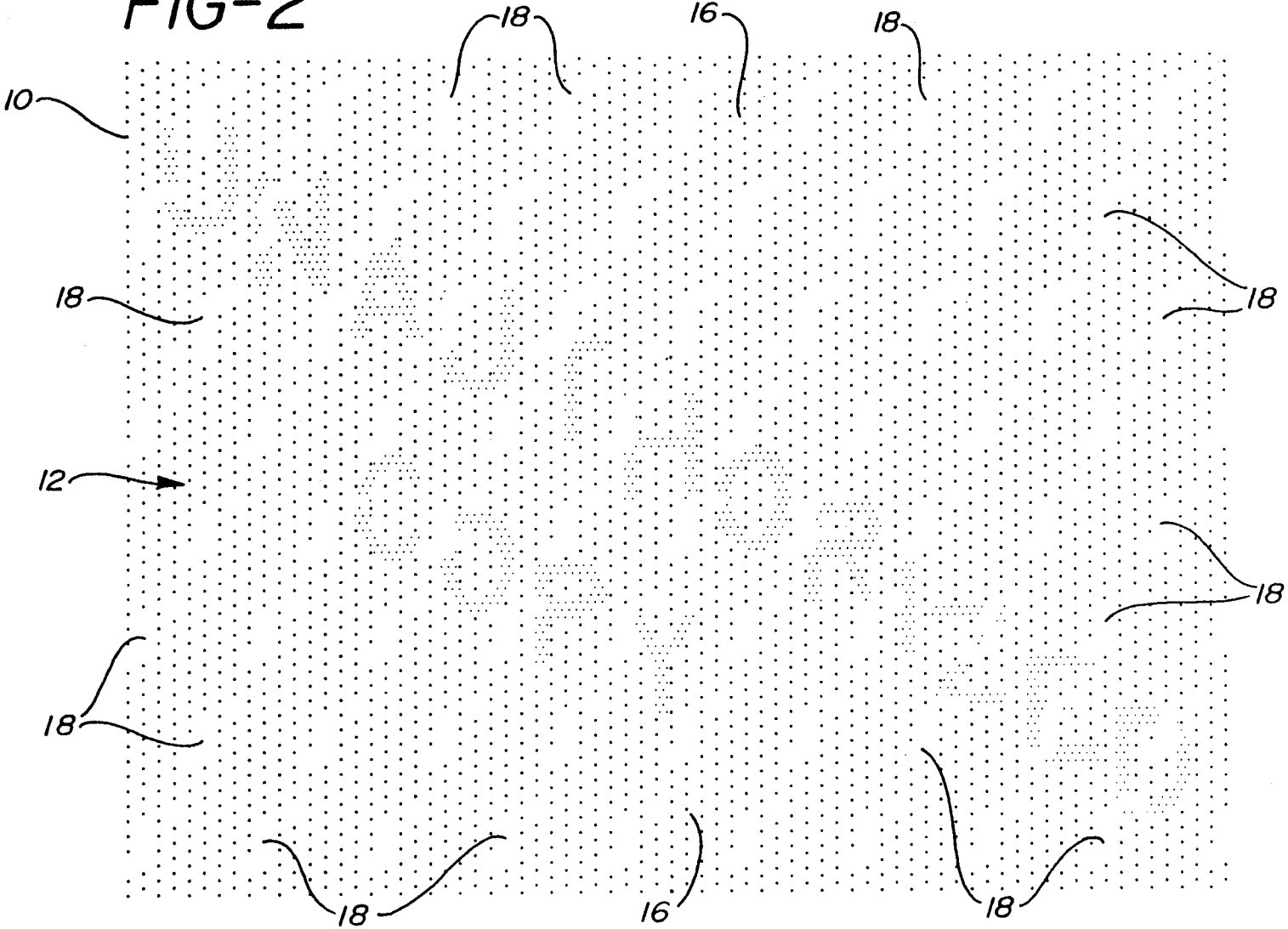
FIG. 2 is a schematic representation of a document, similar to that of FIG. 1, further including a camouflage image extending over the document substrate for confusing the eye of an observer such that the warning image is not readily observed.

Reference is made to FIGS. 1 and 2 which illustrate a security, information document 10, according to the present invention for providing information to a reader from an information source organization. It will be appreciated that the documents are illustrated in the drawings without the information which is to be protected thereon. It should also be understood that FIGS. 1–4 are all schematic, and are not made to scale.

As shown in FIG. 1, the document 10 has a surface or substrate 12 on which the information from the information source organization is to be printed. Typically, the substrate is a sheet of paper; however, other known materials which are suitable for printing may be used instead. A first area 14 on the substrate 12 is printed as a half-tone warning image, in the illustrated case spelling the warning "UNAUTHORIZED COPY." It will be appreciated that the first area is made up of a plurality of separate, non-contiguous portions of the surface 12. Each such portion defines one of the letters making up the warning image. While in some applications the warning image may be made up of a single contiguous portion of the surface of the document 10, the present invention is not so limited. The half-tone warning image is illustrated as printed with a half-tone screen having a relatively large number of lines or dots per inch. An example of a half-tone screen that may be utilized is a screen having 133 lines per inch at 10% area coverage. (For purposes of clarity of illustration, the screens used in the drawings are not to scale.) As is explained below, the warning "UNAUTHORIZED COPY," or the like, is not apparent to the eye of the casual observer of the original document, but is readily noticed on most copies of the document.

A second area 16 is provided on the substrate 12 in which a half-tone background image is printed. The second area 16 surrounds the first area 14, and together the first area 14 and the second area 16 generally cover the document substrate 12. The second area 16 also has a half-tone background image printed thereon having relatively fewer lines or dots per inch, for example, 65 lines per inch at 15% area coverage. As is known, the eye of the observer tends to integrate half-tone images, ignoring the individual half-tone elements and perceiving a shade of color between the color of the ink used to print the half-tone dots and the color of the unprinted document substrate. Although the half-tone warning image and the half-tone background image are shown as printed with half-tone screens made up of dots, it will be appreciated that other half-tone screens, such as for example lines or bars, may be utilized, as well.

FIG. 2 illustrates a security, information document according to the present invention, including a camouflage image. The camouflage image, in the depicted example, is made up of a plurality of "S" shapes or similar shapes 18. The camouflage image extends over the document substrate and confuses the eye of an observer such that the warning image is not readily observed. By proper selection of half-tone screens, the perceived color shades of the first and second areas can be made substantially equal. The range of dot sizes for the two half-tone screens which produces this effect is quite narrow, however, requiring press tolerances that are too demanding for convenient continued commercial production. The camouflage image acts to further obfuscate the warning image, reducing the precision with which the two half-tone screens must be printed.

As shown in FIG. 2, the camouflage image is defined by portions 18 of the first area and the second area in which the half-tone screens are not printed. It is possible to utilize a camouflage image, however, that is defined only by portions of the first area in which half-tone screens are not printed or only by portions of the second area in which half-tone screens are not printed. Alternatively, selected dots may be enlarged or reduced in a camouflage pattern rather then being simply deleted.

As described above, the proper matching of the color produced by the half-tone screen in the first area with the color produced by the half-tone screen in the second area results in the warning image being hidden from the eye of the casual observer of the original document. The warning image is further obscured on the original document by the camouflage image, and the printing tolerances required to produce a document in which the warning image is adequately hidden are eased.

Figure 3:
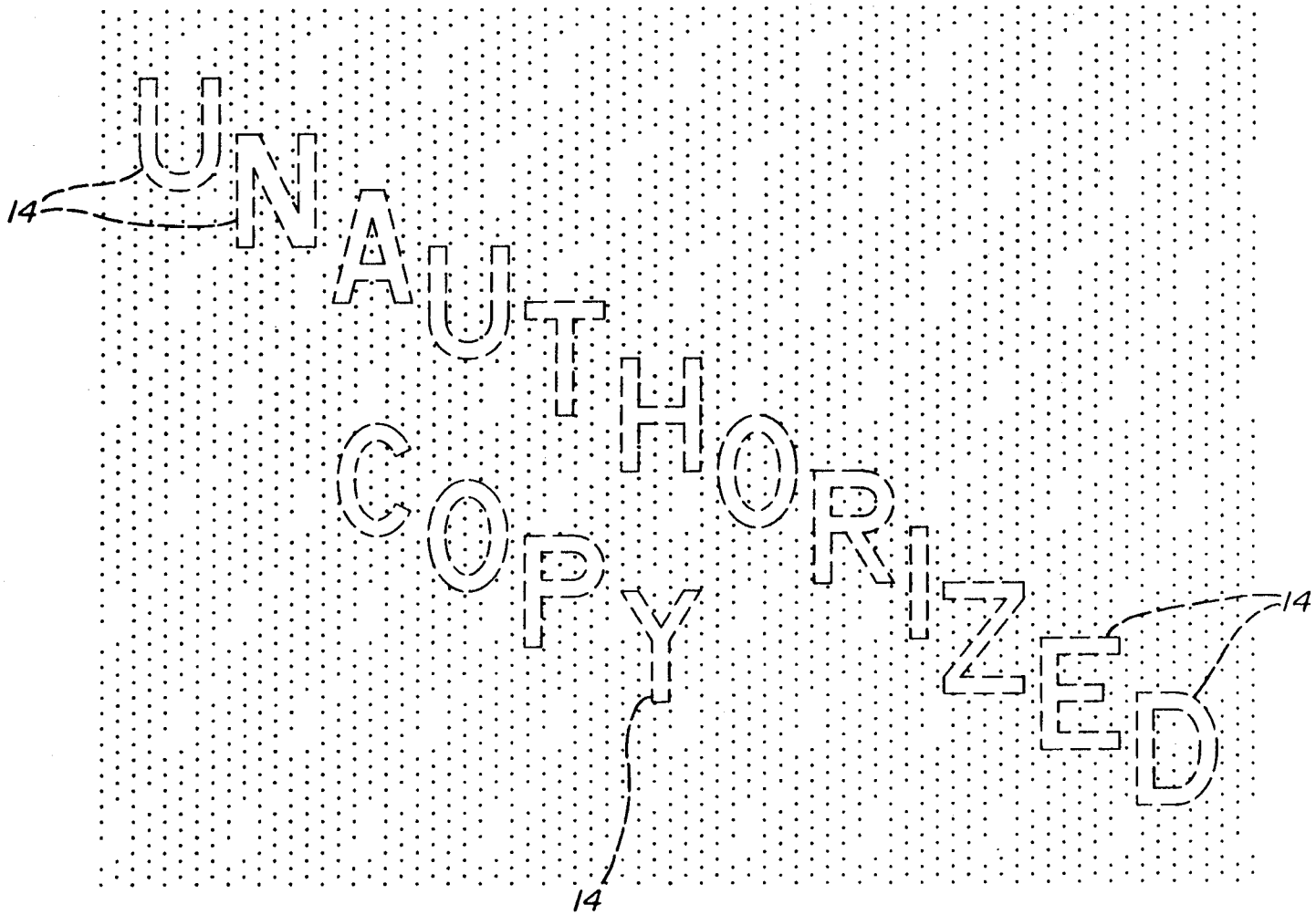
FIG. 3 is a schematic representation of a copy of the document of FIG. 2, illustrating the manner in which the hidden warning image becomes visible.

When a copy is made of the document on conventional xerographic photocopying equipment, however, the warning image, e.g. "UNAUTHORIZED COPY," becomes quite prominent on the face of the copy. This is because the half-tone screen used for printing either the half-tone warning image or the half-tone background image is made up of sufficiently small half-tone elements that it is not readily reproducible by a typical office copier. The optical elements associated with such a copier can only resolve half-tone elements down to a certain size. As a consequence, areas, such as the first area 14 of FIG. 3 in the illustrated example, which have smaller half-tone elements, are not printed in the copy of the document, as shown in FIG. 3 and the warning message becomes apparent on the copy. (The dashed lines surrounding the first area in FIG. 3, are provided to make the warning message more prominent in the drawing, and would not appear on an actual copy. The warning message is typically more prominent on a copy of an actual security, information document in which appropriate half-tone screens are used.) While the first area 14 is shown as printed with a half-tone screen of sufficiently small screen elements so as not to reproduce, and the second area 16 of FIG. 2 is shown as printed with a reproducible half-tone screen, it will be appreciated that this may be reversed, such that the background image drops out on the copy, with no half-tone elements printed in the second area 16 on FIG. 2.

The present invention is of particular utility for providing information to a reader from an information source organization, such as for example an organization that maintains a database of information that it has amassed, and from which it provides customized reports. Other applications for the present invention include reports or proposals which incorporate information that the source organization does not want duplicated and, additionally, does not want copied without attribution.

Figure 4:
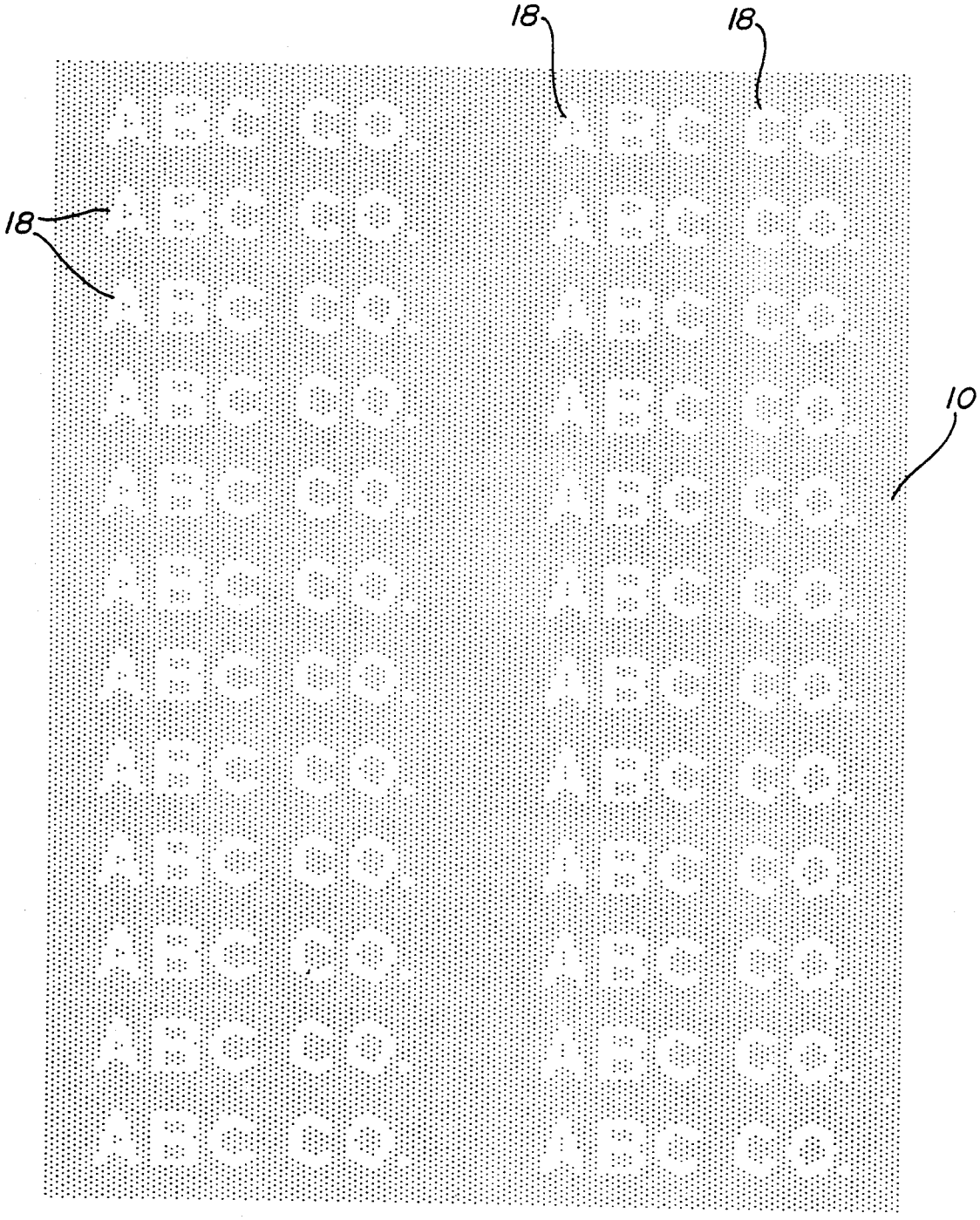
FIG. 4 is a schematic representation of a security, information document for providing information to a reader from an information source organization in which the camouflage image provides an indication of the information source organization.

Reference is made to FIG. 4, which depicts a security, information document according to the present invention. Although not readily apparent in this drawing, it is intended that the document incorporate a hidden warning message in the manner of the document of FIG. 2. Rather than including a camouflage image which is merely an obscuring pattern, the security information document of FIG. 4 includes a camouflage image that delineates the information source organization, in this case "ABC CO." As indicated by the columns of dots, it is preferred that the camouflage image be repeated over the entire document.

In the preferred construction, the half-tone background image and the half-tone warning image are printed in black ink on the document substrate. The information (not shown) that is to be protected from unauthorized copying is printed over the substrate in an ink of substantially the same blackness as the ink used to print the half-tone warning image and the half-tone background image. By this arrangement, an attempt to copy the document without copying the half-tone warning image or the half-tone background image by adjustment of copier settings results in loss of the protected information, as well.

The information to be protected may, in some instances, be printed on the document at the same time as the half-tone images in the first and second areas. It is also possible to produce document sheets including the half-tones and camouflages images at one time and to print the information using conventional printing processes at another time, with the same or another printer. With this approach, it is possible to print the half-tone images in one color ink and the information in another color ink. Documents according to the present invention may be printed by means of conventional copiers or impact or non-impact printers.

In an alternative embodiment, no hidden warning message, and therefore no camouflage image, are provided. The identity of the information source organization is indicated by a half-tone image, on the document substrate over which the information is printed. The half-tone image is printed with a half-tone screen of such a line spacing that the image is readily reproduced on a copy, for example 65 lines per inch of dots of 15% area coverage. The half-tone warning image remains visible over a wide range of copier settings. This embodiment does not give an indication of impropriety to a reader of the copy, but it does insure that the reader will know the source of the information.

Having described the security information document of the present invention in detail and by reference to different embodiments thereof, it will be apparent that certain modifications and variations are possible without departing from the scope of the invention defined in the appended claims.

What is claimed is:

1. A security, information document for providing information to a reader from an information source organization, comprising:

a document substrate;

a first area on said substrate in which a half-tone warning image is printed, delineating said information source organization, said half-tone warning image being printed with a half-tone screen of such a line spacing and element size that it is readily reproducible by a copier;

a second area on said substrate in which a half-tone background image is printed, one of said first and second areas surrounding the other, and in which said information printed over said substrate is printed in an ink of substantially the same blackness as said half-tone warning image and said half-tone background image, whereby an attempt to copy said document without copying said half-tone warning image or said half-tone background image by adjustment of copier settings results in loss of said information.

2. The security, information document of claim 1 for providing information to a reader from an information source organization in which said information is printed over said substrate.

3. The security, information document of claim 1 in which said half-tone background image and said half-tone warning image are printed in black ink on said document substrate.

4. A security, information document for providing information to a reader from an information source organization, comprising:

a document substrate;

a first area on said substrate in which a half-tone warning image is printed, indicating that a copy of the document is an unauthorized document, said half-tone warning image defining the words "UNAUTHORIZED COPY";

a second area on said substrate in which a half-tone background image is printed, said second area surrounding said first area; and a camouflage image extending over said document substrate for confusing the eye of an observer such that said warning image is not readily observed, one of said half-tone warning image and said half-tone background image being printed with a half-tone screen of such a line spacing and element size that it is not readily reproducible by a copier, and in which said information printed over said substrate is printed in an ink of substantially the same blackness as said half-tone warning image and said half-tone background image, whereby an attempt to copy said document without copying said half-tone warning image or said half-tone background image by adjustment of copier settings results in loss of said information.

5. The security, information document of claim 4 for providing information to a reader from an information source organization in which said camouflage image is defined by portions of said first area in which half-tone screens are not printed.

6. The security, information document of claim 4 for providing information to a reader from an information source organization in which said camouflage image is defined by portions of said second area in which half-tone screens are not printed.

7. The security, information document of claim 4 for providing information to a reader from an information source organization in which said camouflage image is defined by portions of said first area and said second area in which half-tone screens are not printed.

8. The security, information document of claim 4 for providing information to a reader from an information source organization in which said camouflage image delineates said information source organization.

9. The security, information document of claim 4 for providing information to a reader from an information source organization in which said information is printed over said substrate.

10. The security, information document of claim 4 in which said half-tone background image and said half-tone warning image are printed in black ink on said document substrate.

* * * * *